US008357005B2

(12) United States Patent
Hu

(10) Patent No.: US 8,357,005 B2
(45) Date of Patent: Jan. 22, 2013

(54) HAIR CURLER CONNECTOR

(75) Inventor: Haowen Hu, Guangdong (CN)

(73) Assignees: Dongguan Fumeikang Electrical Technology Co., Ltd., Dongguan (CN); Haowen Hu

( * ) Notice: Subject to any disclaimer, the term of this patent is extended or adjusted under 35 U.S.C. 154(b) by 271 days.

(21) Appl. No.: 12/813,651

(22) Filed: Jun. 11, 2010

(65) Prior Publication Data

US 2011/0059641 A1 Mar. 10, 2011

(30) Foreign Application Priority Data

Sep. 4, 2009 (CN) ..... 2009 2 0204887 U

(51) Int. Cl.
*H01R 13/627* (2006.01)

(52) U.S. Cl. ..... 439/353; 439/379

(58) Field of Classification Search ..... 439/352, 439/353, 357, 358, 372, 379, 680; 219/222
See application file for complete search history.

(56) References Cited

U.S. PATENT DOCUMENTS

| | | | | | |
|---|---|---|---|---|---|
| 3,779,255 | A * | 12/1973 | Theodorides | ..... | 132/255 |
| 4,314,137 | A * | 2/1982 | Dorn | ..... | 219/222 |
| 4,329,567 | A * | 5/1982 | Kunz et al. | ..... | 219/222 |
| 4,411,281 | A * | 10/1983 | Doern | ..... | 132/229 |
| 5,993,240 | A * | 11/1999 | Schaefer | ..... | 439/359 |
| 6,945,666 | B2 * | 9/2005 | Woolfson | ..... | 362/183 |
| 7,001,200 | B2 * | 2/2006 | Yoshie | ..... | 439/358 |
| 7,060,910 | B2 * | 6/2006 | Wussow et al. | ..... | 174/138 G |
| 7,296,580 | B1 * | 11/2007 | Sbardella | ..... | 132/122 |
| 7,758,996 | B2 * | 7/2010 | Mackle et al. | ..... | 429/97 |

* cited by examiner

*Primary Examiner* — Thanh Tam Le

(57) ABSTRACT

The present invention a hair curler connector, which includes a locking assembly and a buckle, the locking assembly including a lock and a spring assembly, with the lock being equipped with hooks engaged with the buckle. The hair curler connector has simple structure, and it is easy to operate, adapting for different heating components for the convenience of changing.

5 Claims, 3 Drawing Sheets

HAIR CURLER CONNECTOR

FIELD OF THE INVENTION

The present invention relates to hairdressing device, more particularly, the present invention is directed to a hair curler connector adapted different heating component and facilitate changing.

BACKGROUND OF THE INVENTION

Hair curler is a common hairdressing device. The main portion of the hair curler includes a heating component, which engages with the hair and keep the hair in certain curl state, and it pass the heat energy to the hair to style the hair after power up.

In most of the cases, hairs in different quality probably need different heating components respectively. Moreover, the heating components with different shapes or structures are requirement in order to make different hair styles. If special hair curler are respectively prepared for the hair in different quality and styles, the hair curling cost will be greatly increased.

SUMMARY OF THE INVENTION

The technical problem of the present invention to be solved is providing a hair curler connector adapted different heating component and facilitates changing.

In order to solve the above technical problem, the present invention provides with a hair curler connector, which includes a locking assembly and a buckle, the locking assembly including a lock and a spring assembly, with the lock being equipped with hooks engaged with the buckle.

While the hair curler connector applying on the hair curler, one of the buckle and the lock is coupled to the handle of the hair curler, and the other one is coupled to the heating component of the hair curler, whereby the hair curler connector facilitate to connect the handle with the heating component together, which is convenient for disassembly. When changing different heating components based on the requirement of the hair curling, it only needs to change the heating component directly, and the original connector and the handle do not need to change. The function of the spring assembly is to move or distort the lock when assembling and disassembling, so as the hooks depart from the buckles, or the hooks are inserted into the buckle for reposition.

On this basis, the other embodiments of the present invention are as follow:

As one embodiment of the present invention, the lock is a elastic member to integrate with the spring assembly, and the spring assembly and the lock are one-piece structure in this case. The lock itself acts as an elastic member, e.g. plastic member, which makes the lock characterize of elasticity, and the lock is easy to press to be distorted when assembling and disassembling, so as the hooks depart from the buckles.

As another embodiment of the present invention, the spring assembly includes a spring component, with one end of the spring component engaging with the lock. In this case, the spring component is independent of the lock. The user presses the lock when assembling and disassembling, then the elasticity of the spring component is overcome, to make the hooks depart from the buckles; elasticity of the spring component makes the lock to reposition when the user releases the lock. The spring component could be spring or shrapnel.

In order to make things convenient for the user to press the lock when assembling and disassembling the heat component, the lock is equipped with buttons.

The number of the lock is two or above according to the embodiment of the present invention.

Preferably, the number of the lock is two, two locks are in symmetrical arrangement, and two ends of the spring component are engaged with the locks respectively.

The composite structure of the lock and the buckle could be: the buckle is ring shape, and stoppers are symmetrically arranged on the buckle to engage with the two hooks, with the two hooks extending far away from the centre line of the buckle ring in the direction further from the buckle respectively.

In the purpose for guaranteeing stability of the structure, the hair curler connector further comprises a housing, and recessions are symmetrically formed on the housing to engage with the two locks; a mounting portion is formed on the housing to receive the spring component.

For the convenience of making the lock insert into the buckle, a location beam is positioned on the housing, and a location hole is formed on the buckle to engage with the location beam.

The hair curler according to the embodiment of the present invention further comprises conductive pins adapted for electrically connecting to a heating component a hair curler; conductive bores are formed on the housing to receive the conductive pins, and the conductive bores are electrically connected to power lines under control. In this case, only when the lock is coupled to the buckle, and the conductive pins are electrically connected to the conductive bores, the heating component of the hair curler then is connected to power lines.

The advantages of the present invention are sum up as: simple structure, easy to operate; adapted for different heating components for the convenience of changing.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
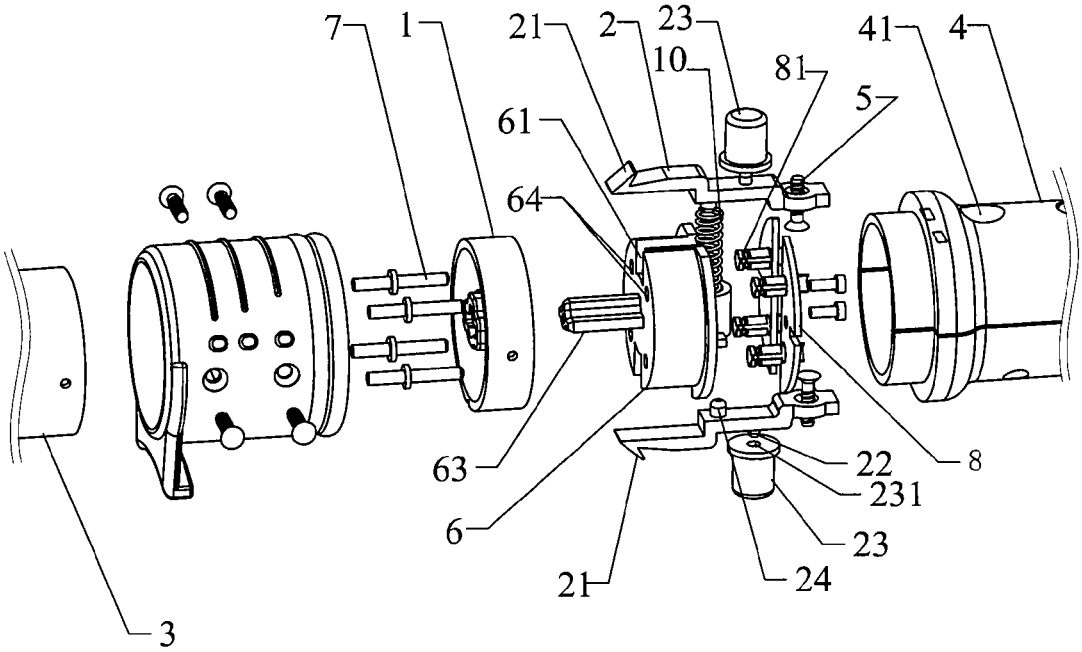
FIG. 1 is a exploded view illustrating the hair curler according to the embodiment of the present invention.

Various preferred embodiments of the invention will now be described with reference to the figures, wherein like reference numerals designate similar parts throughout the various views.

FIG. 1, FIG. 2, FIG. 3, and FIG. 4 illustrate the embodiments of the present invention.

In order to illustrate more clearly, the whole body of the hair curler having the hair curler connector is shown in FIG. 1, FIG. 2, FIG. 3, and FIG. 4. The hair curler includes a heating component 3 and a handle 4, with the heating component 3 being connected to the handle 4 via the hair curler connector.

As shown in FIG. 1, FIG. 2, FIG. 3, and FIG. 4, the hair curler connector includes a buckle 1 and a locking assembly; the buckle 1 is ring shape, a stopper 11 and two symmetrical holes 12 are formed on the buckle 1; the locking assembly has two locks 2 and spring 10 (that is the spring component), wherein two hooks 21 are arranged on the lock 2 to engaged with the stopper 11 and the holes 12, two hooks 21 extending far away from the centre line of the buckle 1 in the direction further from the buckle 1 respectively. Bulges 22 are arranged on the lock 2, buttons 23 are mounted on the lock 2, and the button 23 are provided with sinkhole 231 to receive bulges 22, wherein the bulges 22 are inserted into the sinkhole 231, and the buttons 23 are explored from the outer surface of the handle 4 to facilitate operation (referring to FIG. 3); the lock 2 is further equipped with support rods 24, with two ends of the spring 10 respectively covering on the support rods 24 to engage with the locks 2. The buckle 1 is mounted on the heating component 3, and the right end of two locks 2 respectively mounted on the internal wall of the handle 4 by two screws 5. The mounting holes 4 are formed on the outer surface of the handle 4 to receive the buttons 23.

The handle 4 is equipped with a housing 6, two recessions 61 engaged with two locks 2 are symmetrically arranged on the housing 6 to position the locks 2; a mounting portion 62 is formed on the housing 6 to receive the spring 10. A location beam 63 is positioned in the center of the housing 6, and correspondingly a location hole 13 is formed in the center of the buckle 1 to engage with the location beam 63.

Four conductive pins 7 are respectively electrically connected to the electric heating element within the heating component 3, and the corresponding structures are arranged on the lock 1 to position four conductive pins 7; four conductive bores 64 are formed on the housing 6 correspondingly to received four conductive pins 7 respectively, a PCB plate 8 is arranged on the housing 6 to electrically connect to power lines, four contact rings 81 are arranged on the PCB plate 8 to engaged with four conductive pins 7, wherein the contact rings 81 are electrically connected to the PCB plate 8, and the contact rings 81 are electrically connected to the PCB plate 8, with the left end of the contact ring 81 inserting into bores 64 to form the conductive bores.

Figure 2:
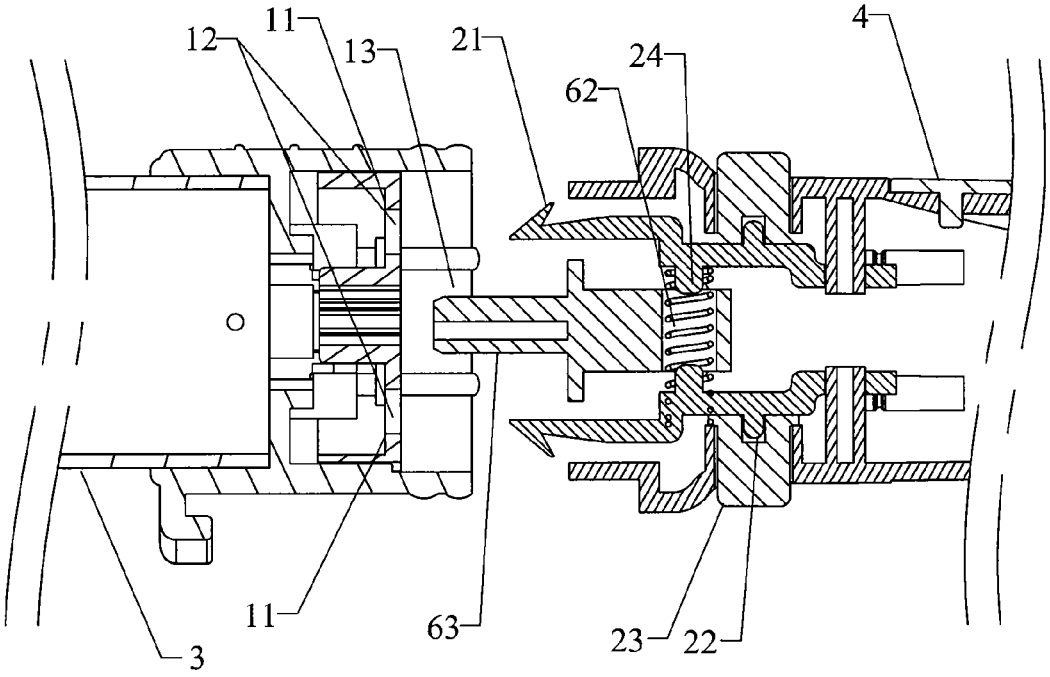
FIG. 2 is a partial section view illustrating the hair curler (the state of the lock 2 departing from the buckle 1) according to the embodiment of the present invention shown in FIG. 1.
Figure 3:
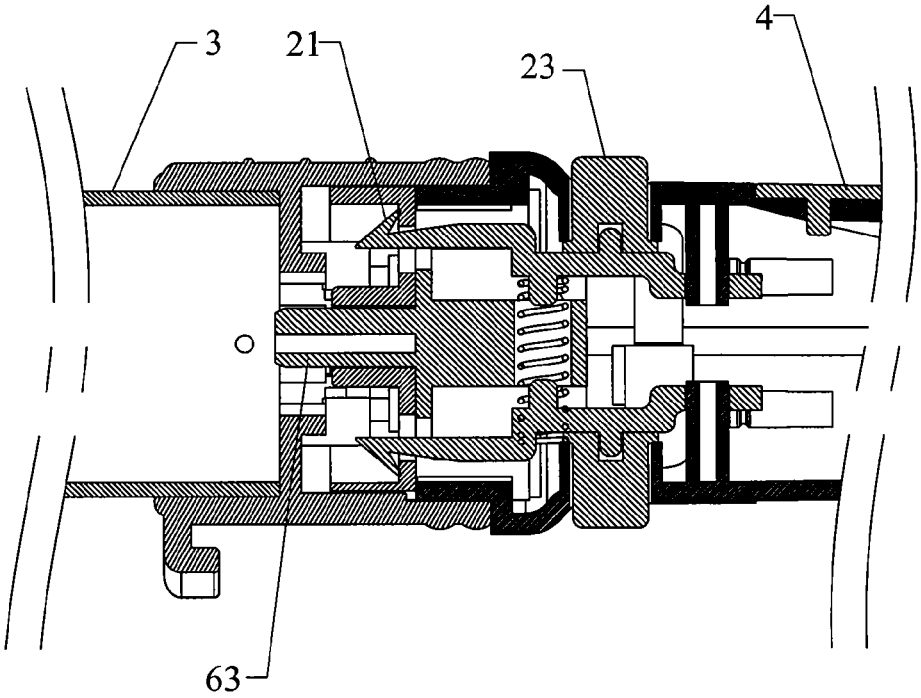
FIG. 3 is a partial section view illustrating the hair curler (the state of the lock 2 combining to the buckle 1) according to the embodiment of the present invention shown in FIG. 1.
Figure 4:
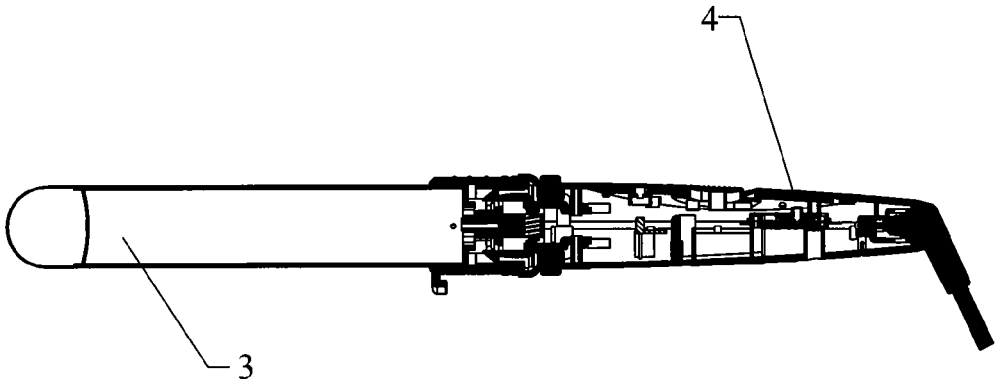
FIG. 4 is section view illustrating the hair curler (the state of the lock 2 combining to the buckle 1) according to the embodiment of the present invention shown in FIG. 1.

Whiling assembling, referring to FIG. 2, the button 23 is pressed to make the spring 10 compressed, then two hooks 21 are got closer; the handle 4 is forced to get close to the heating component 3, the location beam 63 is inserted into the location hole 13, two hooks 21 respectively run through two holes 12, and four conductive pins 7 are respectively inserted into the corresponding bores 64, until the hooks 21 are strode over the stopper 11 of the buckle 1. Meanwhile four conductive pins 7 are respectively contacted with the contact rings 81 of the bores 64, releasing the button 23, the elasticity of the spring 10 forces two hooks 21 apart, and two hooks 21 are respectively positioned on the stopper 11, and then the heating component 3 and the handle 4 are assembled together. The power supply is electrically connected to the heating component via the PCB plate 8, the contact rings 81, and the conductive pins 7.

When changing of the heating component is needed, the button 23 is pressed to make the spring 10 compressed, then two hooks 21 are got closer. Pull the handle 4 apart from the heating component 3, two hooks 21 are respectively released from the two holes 12 of the buckle 1, four conductive pins 7 are respectively released from the bores 64, until the hooks 21 are released from the buckle 1. Releasing the button 23, four conductive pins 7 are respectively released from the contact rings 81, whereby the power supply is cut off. Assemble the changed heating component 3 together with the buckle 1 and the conductive pins 7, and then assemble the heating component 3 and the handle 4 together according to the assembling process.

While, it is to be understood that the invention is not to be limited to the disclosed embodiments, but on the contrary, is intended to cover various modifications and equivalent arrangements included within the spirit and scope of the invention.

As indicated above, the invention has been described in connection with what are presently considered to be the most practical and preferred embodiments, but it is not intended to limit the scope of protection of the present invention through the above description. The field technician can easily reach all of the changes and improvements should fall within the scope of protection is not the invention, and such modifications and variations that may be apparent to those skilled in the art are intended to be included within the scope of the present invention.

What is claimed is:

1. A hair curler connector comprising a locking assembly and a buckle, the locking assembly including two locks and a spring assembly, each lock being equipped with a hook engaged with the buckle;

wherein the spring assembly includes a spring component, the two locks are in symmetrical arrangement and two ends of the spring component are engaged with the two locks respectively;

wherein the buckle is a ring shape and stoppers are symmetrically arranged on the buckle to engage with the two hooks, and the two hooks extending far away from a centre line of the buckle in a direction further from the buckle respectively;

wherein the hair curler connector further comprises a housing, recessions are symmetrically formed on the housing to engage with the two locks and a mounting portion is formed on the housing to receive the spring component; and wherein a location beam is positioned on the housing and a location hole is formed on the buckle to engage with the location beam.

2. The hair curler connector as claimed in claim 1, wherein the lock is an elastic member to integrate with the spring assembly.

3. The hair curler connector as claimed in claim 1, wherein buttons are arranged on the lock.

4. The hair curler connector as claimed in claim 3, wherein the number of the lock is two or above.

5. The hair curler connector as claimed in claim 1, wherein the hair curler connector further comprises conductive pins adapted for electrically connecting to a heating component of a hair curler; conductive bores are formed on the housing to receive the conductive pins, and the conductive bores are electrically connected to power lines under control.

* * * * *